US012352049B2

(12) United States Patent
Knudson

(10) Patent No.: US 12,352,049 B2
(45) Date of Patent: Jul. 8, 2025

(54) GUTTER COVER SYSTEM

(71) Applicant: Gary A. Knudson, Superior, CO (US)

(72) Inventor: Gary A. Knudson, Superior, CO (US)

( * ) Notice: Subject to any disclaimer, the term of this patent is extended or adjusted under 35 U.S.C. 154(b) by 0 days.

(21) Appl. No.: 17/747,082

(22) Filed: May 18, 2022

(65) Prior Publication Data

US 2022/0372763 A1 Nov. 24, 2022

Related U.S. Application Data

(60) Provisional application No. 63/189,927, filed on May 18, 2021.

(51) Int. Cl.
*E04D 13/076* (2006.01)
*E04D 13/068* (2006.01)

(52) U.S. Cl.
CPC ..... *E04D 13/076* (2013.01); *E04D 13/068* (2013.01)

(58) Field of Classification Search
CPC ..... E04D 13/076; E04D 13/068
USPC ..... 52/12
See application file for complete search history.

(56) References Cited

U.S. PATENT DOCUMENTS 546,042 A * 9/1895 Horn ..... E04D 13/076 52/12
2,669,950 A * 2/1954 Bartholomew ..... E04D 13/076 52/12
2,674,961 A * 4/1954 Lake ..... E04D 13/076 52/12
4,435,925 A * 3/1984 Jefferys ..... E04D 13/076 52/12
4,937,986 A 7/1990 Way, Sr. et al.
5,406,755 A 4/1995 Serano
5,845,435 A 12/1998 Knudson
7,913,458 B2 3/2011 Higginbotham
8,297,000 B1 10/2012 Demartini
9,021,747 B2 5/2015 Lenney et al.
10,648,178 B2 5/2020 Stacye
11,193,280 B2 12/2021 Lenney
2004/0250478 A1 12/2004 McDonald et al.
2005/0108951 A1 5/2005 McDonald et al.
2006/0277831 A1 12/2006 Bachman
2011/0114800 A1 5/2011 Gramling
2012/0222366 A1 9/2012 Steinberg et al.
2013/0160378 A1 6/2013 Higginbotham
2015/0225959 A1 8/2015 Lenney

FOREIGN PATENT DOCUMENTS

EP 1482103 A1 * 12/2004 ..... E04D 13/076
GB 2443251 A * 4/2008 ..... E04D 13/076
GB 2488434 A * 8/2012 ..... E04D 13/076

* cited by examiner

*Primary Examiner* — Babajide A Demuren
(74) *Attorney, Agent, or Firm* — John R. Hayden; Cochran Freund & Young LLC

(57) ABSTRACT

A gutter cover system has a reverse-curve cover and clips, fastened to fascia, that secure the back edge of the cover. The front of the cover has an S shape with a convex upper part and a concave lower part. The lower part clips inside the upper front edge of the gutter. The cover is corrugated with fore-aft extending ridges and grooves. The corrugations create small triangular openings for water to enter the gutter while preventing small leaves and evergreen needles from entering the gutter.

11 Claims, 5 Drawing Sheets

GUTTER COVER SYSTEM

TECHNICAL FIELD

The present invention relates to rain gutters, and more particularly to an impermeable, corrugated rain gutter cover and system.

BACKGROUND ART

Open trough rain gutters collect debris that falls on the roof and washes down with the rain water. Systems to shield the rain gutter from debris include screens over the open trough and reverse-curve covers. The screens have a tendency to clog with small debris, such as evergreen needles, blocking the rain water from entering the rain gutter.

Reverse-curve covers or hoods generally have a sloped planar section that extends over the rain gutter and a coextensive convex curved section that first curves forwardly and downwardly over the front of the rain gutter and then curves downwardly and inwardly. Rain water, through liquid adhesion principles, follows the curved section to the lower edge of the shield and falls from this lower edge into the rain gutter. Debris washed down by the rain water falls off at the forward extent of the curved section of the shield and drops to the ground.

Generally reverse-curve cover systems have a gap of about one-half inch between the cover and the upper end of the front wall of the gutter to allow water to enter the gutter. Most of these reverse-curve cover systems require special front-edge gutter to cover connectors or gutter hangers to space the front of the cover above the gutter to create this gap. Known reverse-curve cover systems work fairly well for larger leaves, but generally fail to prevent smaller leaves and evergreen needles from entering the gutters through this space between the gutter and the cover.

Disclosure of the Invention

A gutter cover system for an open trough rain gutter includes a plurality of clips and a gutter cover. The cover is made of an impermeable material and has a back edge, a front edge, a body and a nose. The body has a linear profile that slopes downwardly, forwardly. The nose has a convex first section that curves from the body forwardly, downwardly and then rearwardly, downwardly, and a concave second section that curves from the first section rearwardly, downwardly and then forwardly, downwardly. The cover is corrugated, having alternating fore-alt extending V-shaped grooves and ridges. The cover is sized such that the ridges on the nose contact the upper end of the front wall of the gutter and the second section of the nose clips to the upper end of the front wall of the gutter. The clips are horizontally spaced on the facia above the back wall of the gutter, and secure the back edge of the cover. Rain water flows down the grooves, around the nose, and into the gutter, and the ridges prevent small leaves and evergreen needles from entering the gutter.

BRIEF DESCRIPTION OF THE DRAWINGS

Details of this Invention are Described in Connection with the Accompanying Drawings that Bear Similar Reference Numerals in which.

DETAILED DESCRIPTION OF THE INVENTION

Figure 1:
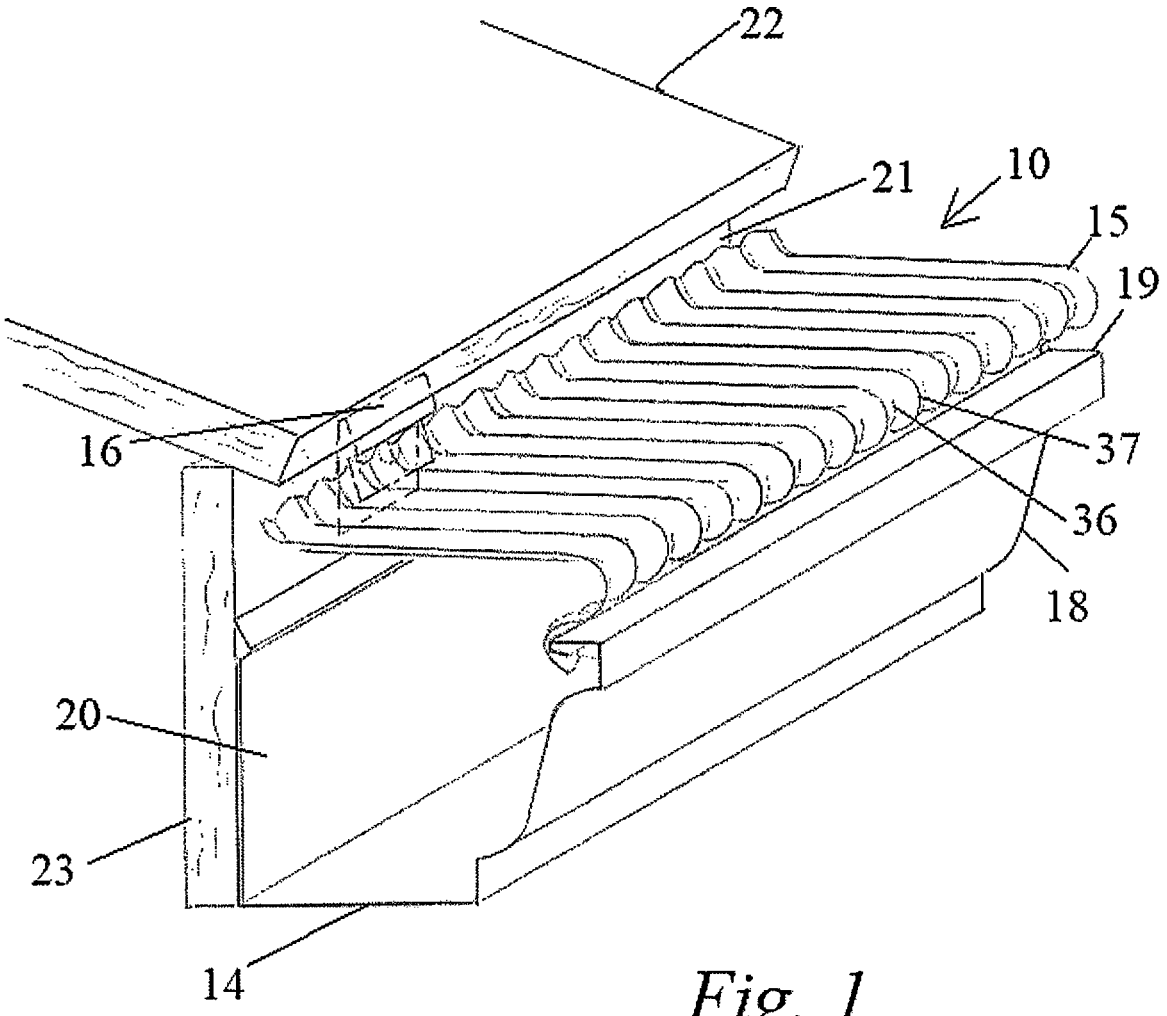
FIG. 1 is a perspective view of a gutter cover system embodying features of the present invention.
Figure 2:
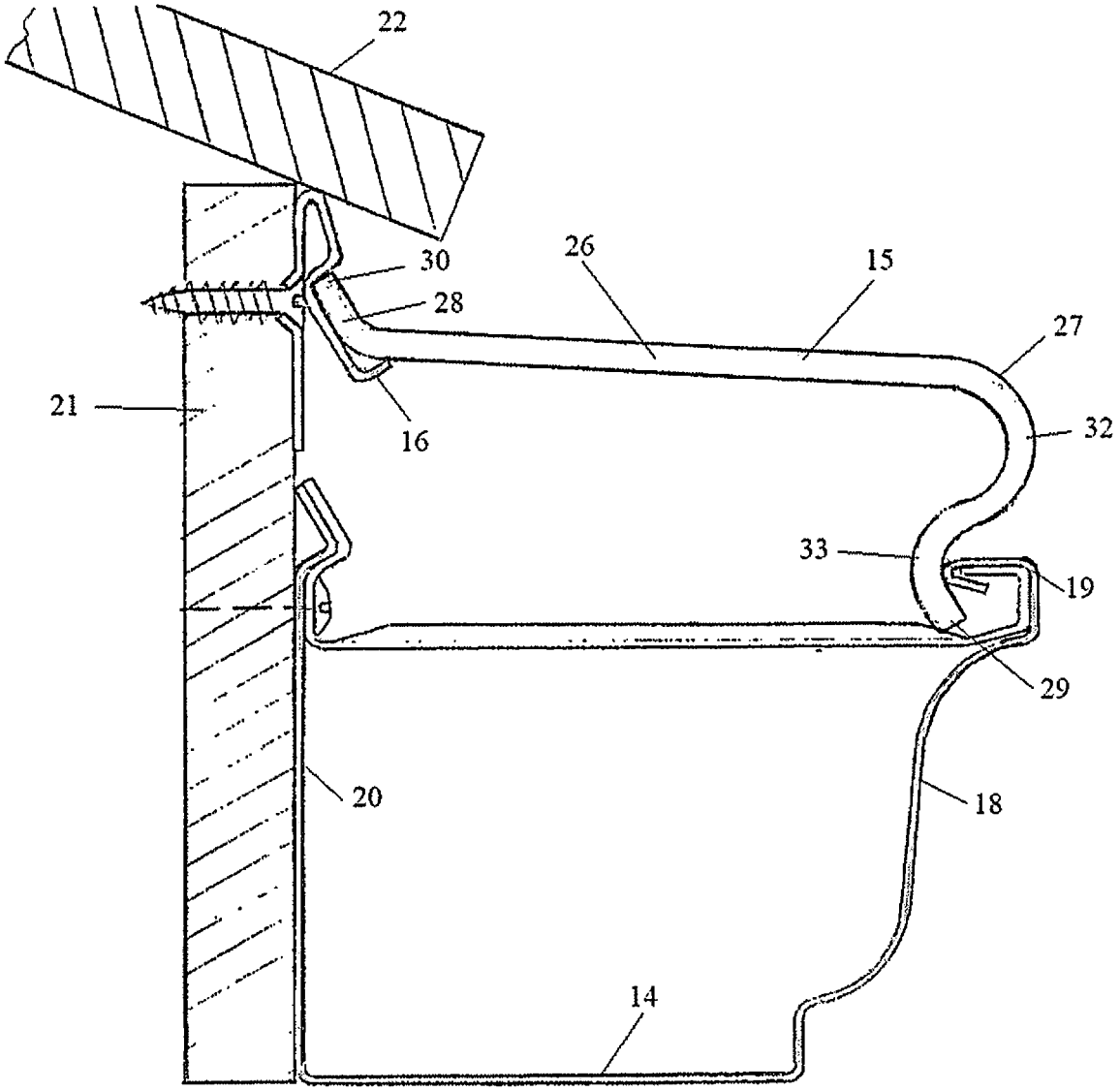
FIG. 2 is a side elevation view of the system of FIG. 1.

Referring to FIGS. 1 to 5, a gutter cover system 11 for an open trough rain gutter 14, embodying features of the present invention, includes a gutter cover 15 and a plurality of clips 16. The gutter 14 has a front wall 18 with an upper end 19 and a spaced back wall 20 attached to facia 21 below a roof 22 of a building 23.

The cover 15 includes a body 26, a nose 27, a flange 28, a back edge 29, and a front edge 30. The body 26 has a linear profile, when viewed from the side, and slopes downwardly, forwardly. The nose 27 has an S shaped profile with a rounded convex first section 32 and a rounded concave second section 33. The first section 32 curves forwardly, downwardly and then rearwardly, downwardly from the body 26. The second section 33 curves from the first section 32 rearwardly, downwardly and then forwardly, downwardly to the front edge 30. The flange 28 projects from the body 26 upwardly, rearwardly to the back edge 29.

The cover 15 is made of an impermeable material. Preferably the cover 15 is made from roll formed sheet metal. The cover 15 can also be made of plastic or vinyl. The cover 15 is corrugated, having alternating fore-alt extending grooves 36 and ridges 37. The grooves 36 and ridges 37 have substantially the same shape and size, a U shape or V shape. On the cover 15 shown the grooves 36 and ridges 37 extend from the back edge 29 to the front edge 30. Preferably the grooves 36 and ridges 37 extend at least from the body 26 across the nose 27 to the front edge 30.

Figure 6:
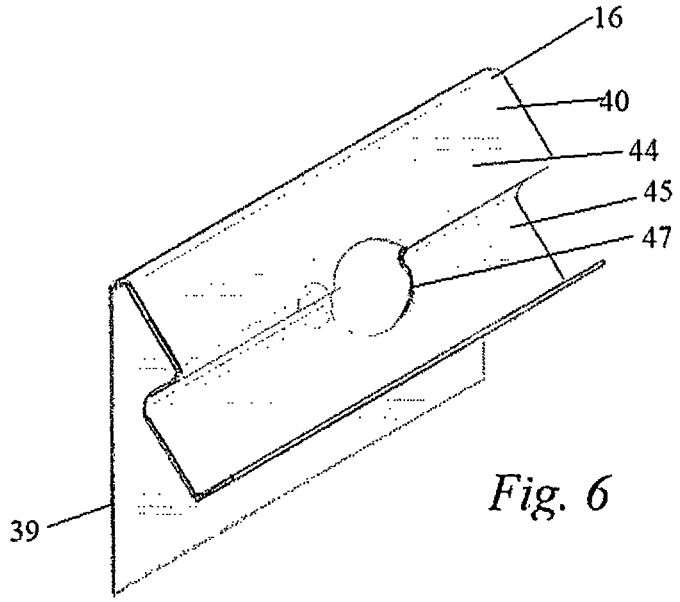
FIG. 6 is a perspective view a clip of the system of FIG. 1.
Figure 7:
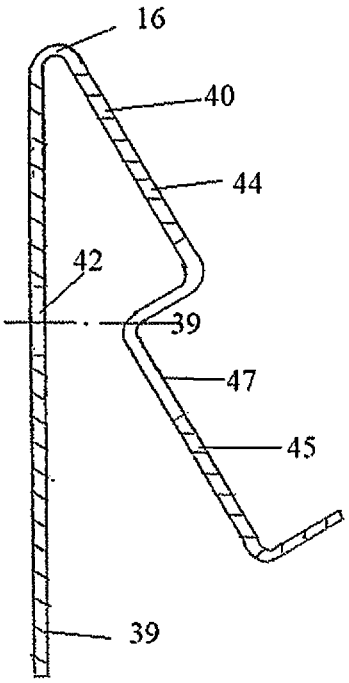
FIG. 7 is a side elevation view of a clip of the system of FIG. 1.
Figure 8:
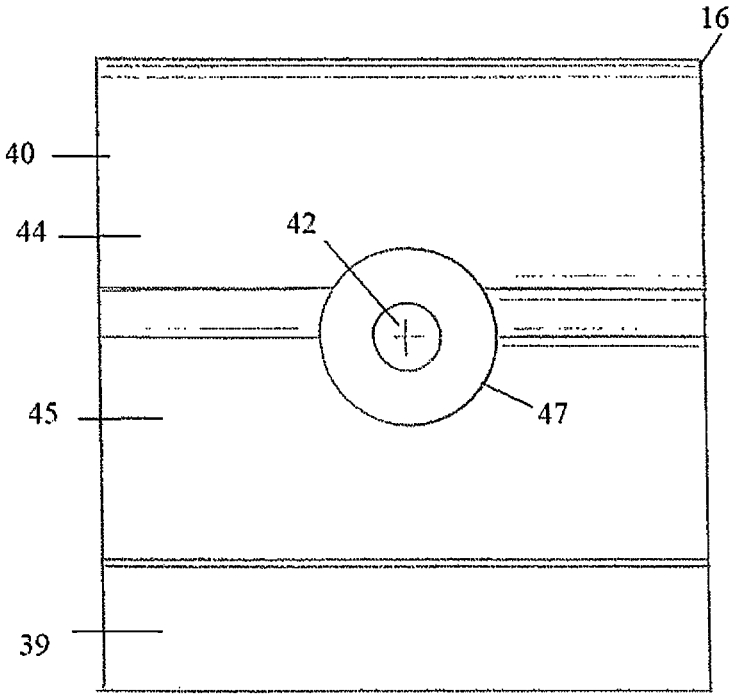
FIG. 8 is a front view a clip of the system of FIG. 1.

The clips 16 are horizontally spaced and mounted on the facia 21 between the back wall 20 of the gutter and the roof 22. As shown in FIGS. 6 to 8, each clip 16 has a planar back portion 39 and a front portion 40. The back portion 39 is planar and rectangular. A mounting aperture 42 extends through the back portion 39, sized to receive a fastener for mounting the back portion 39 on the fascia 21.

The front portion 40 projects downwardly, forwardly from the top of the back portion 39. The front portion 40 has a planar first portion 44 that connects to the back portion 39 and an upwardly, forwardly opening, trough shaped second section 45 that connects to the first section 44 opposite the back portion 39. The second section 45 is sized and shaped to receive the flange 28 of the cover 15. A fastener aperture 47 extends through the front portion 40. The fastener aperture 47 is sized and positioned to allow the head of a fastener in the mounting aperture 42 to pass through. The clips 16 are made of a resilient material such as sheet-metal strip having sufficient alloy and heat treating character to provide spring-retained tension against the cover 16.

Figure 3:
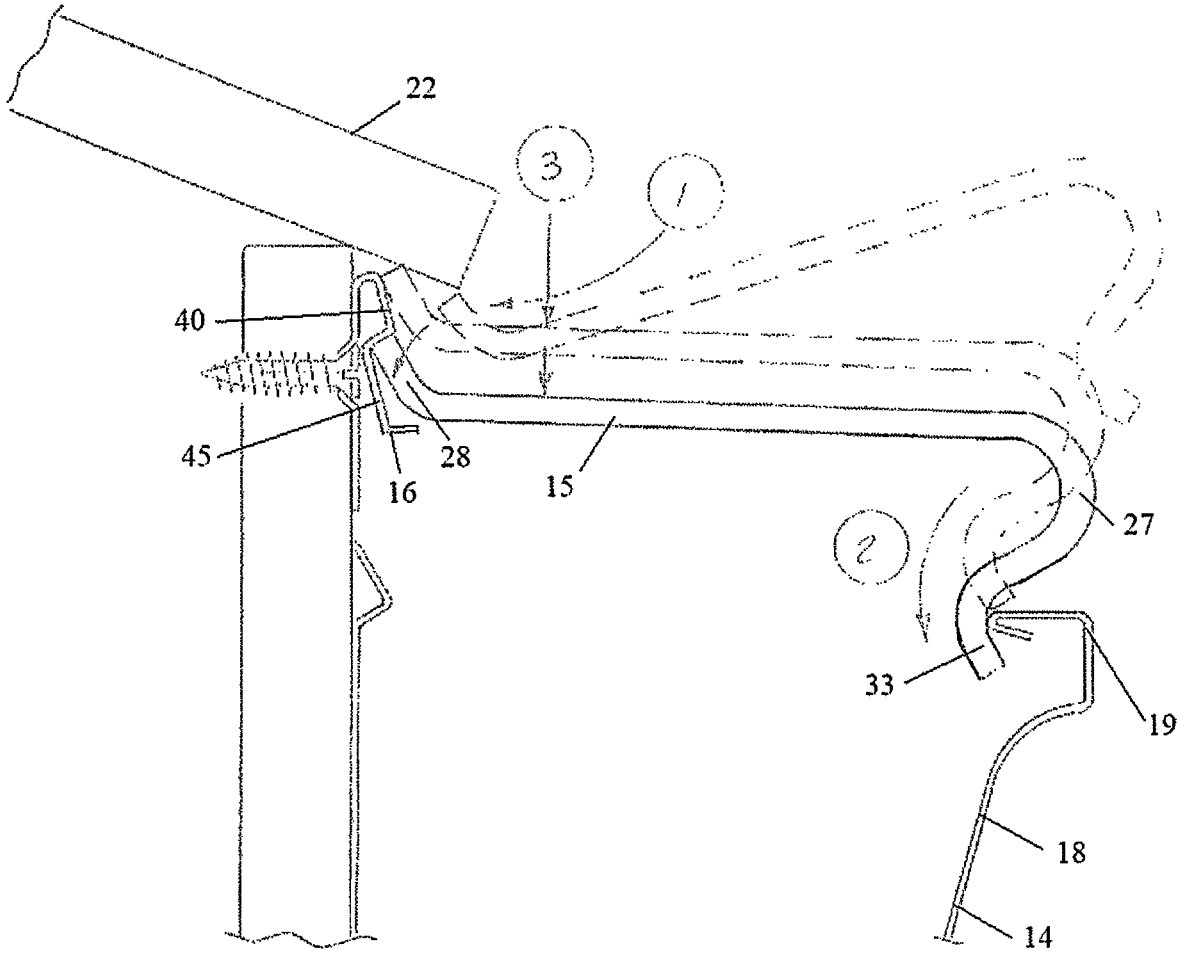
FIG. 3 is another side elevation view of the system of FIG. 1, with phantom lines and circled step numbers showing the steps of installation of the cover.
Figure 4:
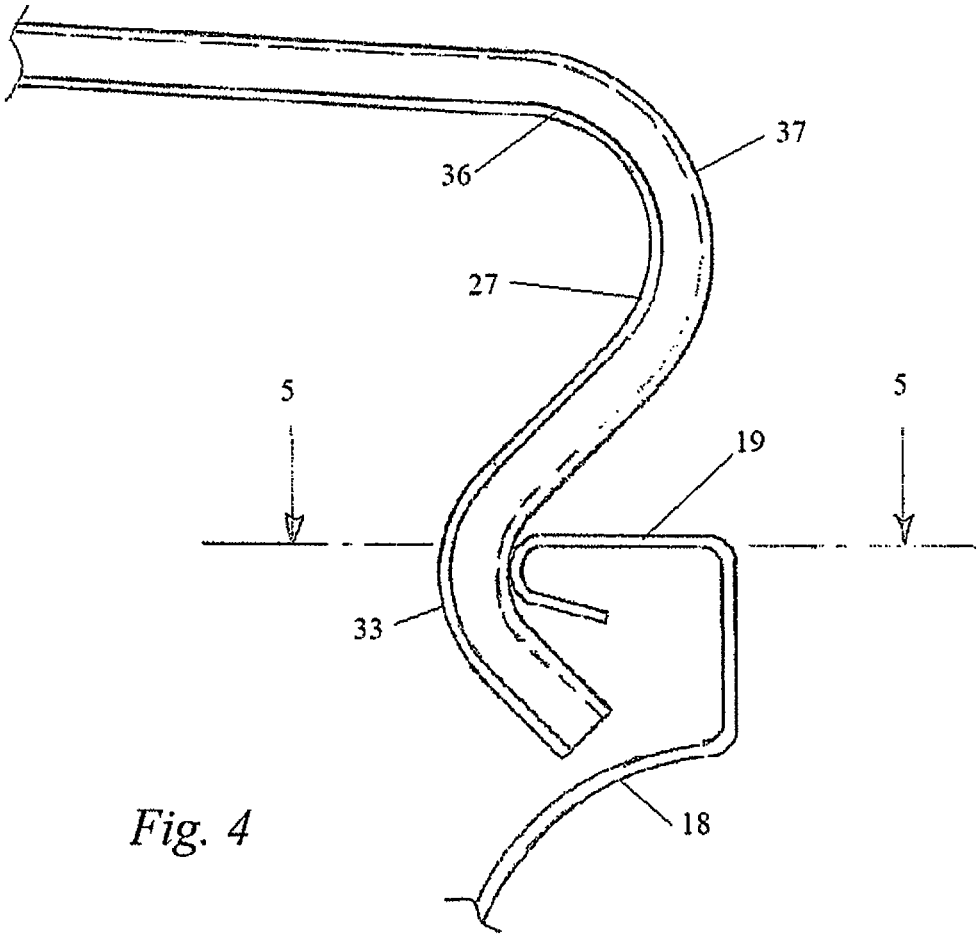
FIG. 4 is an enlarged side elevation view of the nose of the cover of the system of FIG. 1.

The cover 15 is sized such that the ridges 37 rest on the upper end 19 of the front wall 18 of the gutter 14 and the second section 33 of the nose 27 clips inside the upper end 19 of the front wall 18 of the gutter 14. Referring to FIG. 3, the cover 15 is assembled to the gutter 14 by first inserting the flange 28 under the edge of the roof 22, above the clips 16. Next the second section 33 of the nose 27 is inserted inside the upper end 19 of the front wall 18 of the gutter 14. Then the flange 28 is inserted into the second section 45 of the front portion 40 of the clips 16.

Figure 5:
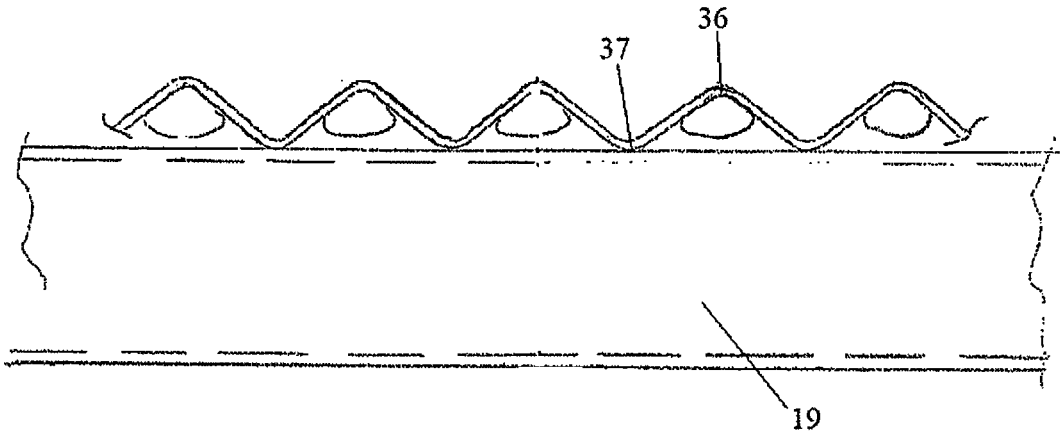
FIG. 5 is a sectional view of FIG. 4 taken along line 5-5.

As shown in FIG. 5, the system 10 provides small triangular openings that allow water to enter the gutter 11 while preventing small leaves and evergreen needles from entering the gutter 14. The system 10 also eliminates the need for the special front-edge gutter to cover connectors or the special gutter hangers required by most known reverse-curve cover systems to space the front of the cover above the gutter 14.

Although the present invention has been described with a certain degree of particularity, it is understood that the present disclosure has been made by way of example and that changes in details of structure may be made without departing from the spirit thereof.

What is claimed is:

1. A gutter cover system for an open trough rain gutter having a front wall with an upper end and a spaced back wall attached to facia below a roof of a building, comprising:

a plurality of horizontally spaced clips mountable on said facia above said back wall, and a gutter cover of impermeable material having a back edge, a front edge, a body and a nose, said body having a linear profile that slopes downwardly, forwardly, said nose having a convex first section that curves from said body forwardly, downwardly and then rearwardly, downwardly, and a concave second section that curves from said first section rearwardly, downwardly and then forwardly, downwardly to said front edge, said second section being sized and shaped to clip into said upper end of said front wall of said gutter, said nose having alternating fore-alt extending grooves and ridges extending from said body to said front edge with said grooves having a selected shape and said ridges having said shape, said back edge being shaped to be received and secured by said clips, and said cover being sized such that said ridges on said nose contact said upper end of said front wall of said gutter, whereby rain water flows down said grooves, around said nose, into said gutter, and said ridges prevent small leaves and evergreen needles from entering said gutter.

2. The system as set forth in claim 1 wherein said shape is a V shape.

3. The system as set forth in claim 1 wherein said cover includes a flange that projects upwardly, rearwardly from said body to said back edge, said flange being shaped to be received by said clips.

4. The system as set forth in claim 1 wherein said grooves and ridges extend rearwardly from said nose to said back edge.

5. The system as set forth in claim 1 wherein said cover is made of roll formed metal.

6. A gutter cover system for an open trough rain gutter having a front wall with an upper end and a spaced back wall attached to facia below a roof of a building, comprising:

a plurality of horizontally spaced clips mountable on said facia above said back wall, and a roll formed metal gutter cover having a back edge, a front edge, a body, a nose and a flange, said body having a linear profile that slopes downwardly, forwardly, said nose having a convex first section that curves from said body forwardly, downwardly and then rearwardly, downwardly, and a concave second section that curves from said first section rearwardly, downwardly and then forwardly, downwardly to said front edge, said flange projecting upwardly, rearwardly from said body to said back edge, said cover having alternating fore-alt extending grooves and ridges extending from said back edge to said front edge with said grooves having a V shape and said ridges having said V shape, said flange being shaped to be received and secured by said clips, said cover being sized such that said ridges on said nose contact said upper end of said front wall of said gutter, and said second section being sized and shaped to clip into said upper end of said front wall of said gutter, whereby rain water flows down said grooves, around said nose, into said gutter, and said ridges prevent small leaves and evergreen needles from entering said gutter.

7. A gutter cover for an open trough rain gutter having a front wall with an upper end and a spaced back wall attached to facia below a roof of a building, comprising:

a front edge, a back edge, a body having a linear profile that slopes downwardly, forwardly, and a nose having a convex first section that curves from said body forwardly, downwardly and then rearwardly, downwardly, and a concave second section that curves from said first section rearwardly, downwardly and then forwardly, downwardly to said front edge, said second section being sized and shaped to clip into said upper end of said front wall of said gutter, said nose having alternating fore-alt extending grooves and ridges extending from said body to said front edge with said grooves having a selected shape and said ridges having said shape, and said nose being sized such that said ridges on said nose contact said upper end of said front wall of said gutter, whereby rain water flows down said grooves, around said nose, into said gutter and said ridges prevent small leaves and evergreen needles from entering said gutter.

8. The system as set forth in claim 7 wherein said shape is a V shape.

9. The system as set forth in claim 7 wherein said cover includes a flange that projects upwardly, rearwardly from said body to said back edge.

10. The system as set forth in claim 7 wherein said grooves and ridges extend rearwardly from said nose to said back edge.

11. The system as set forth in claim 7 wherein said cover is made of roll formed metal.

* * * * *